US005528919A

United States Patent [19]

McGrady et al.

[11] Patent Number: 5,528,919

[45] Date of Patent: Jun. 25, 1996

[54] ROLL GROOVING APPARATUS

[75] Inventors: Jeffrey L. McGrady, Medina; David L. Machovina, Elyria, both of Ohio

[73] Assignee: Emerson Electric Company, St. Louis, Mo.

[21] Appl. No.: 382,783

[22] Filed: Feb. 2, 1995

[51] Int. Cl.[6] ..... B21D 17/04

[52] U.S. Cl. ..... 72/121; 72/105

[58] Field of Search ..... 72/101, 105, 106, 72/110, 124, 120, 121

[56] References Cited

U.S. PATENT DOCUMENTS

| | | | |
|---|---|---|---|
| 2,975,819 | 3/1961 | Costanzo et al. | 153/9 |
| 3,995,466 | 12/1976 | Kunsman | 72/106 |
| 4,041,747 | 8/1977 | Elkin | 72/105 |
| 4,144,733 | 3/1979 | Whitten | 72/105 |
| 5,079,940 | 1/1992 | Pulver et al. | 72/105 |
| 5,279,143 | 1/1994 | Dole | 72/105 |

*Primary Examiner*—Lowell A. Larson
*Attorney, Agent, or Firm*—Vickers, Daniels & Young

[57] ABSTRACT

Apparatus for roll grooving thin wall pipe comprises a housing supporting a female drive roll and an arm pivotally mounted on the housing and supporting a male idler roll. A feed screw between the housing and arm provides for pivoting the arm to displace the idler roll radially toward and away from the drive roll, and a quick release arrangement between the feed screw and housing is operable to release the arm to displace the idler roll away from the drive roll at the end of a roll grooving operation without rotating the feed screw. Self-tracking during a roll grooving operation is provided by teeth on an outer surface of the drive roll which urge the pipe and grooving rolls axially inwardly relative to one another.

54 Claims, 5 Drawing Sheets

ROLL GROOVING APPARATUS

BACKGROUND OF THE INVENTION

This invention relates to the art of roll grooving apparatus and, more particularly, to improvements in such apparatus relating to the quick release of grooving roll components and maintaining tracking between the grooving rolls and workpiece so that the rolled groove is transverse to the workpiece axis.

The present invention finds particular utility in conjunction with a portable roll groover which is adapted to be interengaged with a rigidly supported pipe to be grooved and which, during the roll grooving operation, travels about the periphery of the pipe. Accordingly, the invention will be illustrated and described herein in conjunction with such a portable roll groover; however, it will be understood and appreciated from the disclosure herein that the invention is applicable to roll grooving apparatus of the character wherein the roll groover is rigidly supported and the pipe to be grooved rotates relative thereto during the grooving operation.

Roll grooving apparatus is of course well known and, generally, includes relatively displaceable first and second housing components or supports respectively rotatably supporting a backup grooving roll and an idler grooving roll between which a pipe to be grooved is interposed during a grooving operation. The grooving rolls are matingly contoured and, in this respect, the backup roll is provided with a peripheral groove and the idler roll is provided with a peripheral projection such that a pipe therebetween is provided with a peripheral groove upon relative rotation of the grooving rolls and relative radial displacement of the grooving rolls toward one another. Most often, the backup roll is a drive roll rotated by a hand tool or by a drive motor depending on the particular type of roll grooving apparatus, but both the backup and idler rolls can idle in apparatus of the type wherein the pipe is rotated during the roll grooving operation.

Often, relative displacement between the grooving roll supports is achieved through the use of threaded feed screw arrangements between the supports and which include a screw component which is manually rotated by hand or by a tool such as a wrench. The grooving roll supports are interengaged for linear or pivotal displacement toward and away from one another, whereby it will be appreciated that considerable time is required to set up and to perform a roll grooving operation on a pipe. In this respect, the feed screw must be manually rotated in the direction to separate the grooving rolls to facilitate the insertion of the end of a tube therebetween, and the feed screw must then be manually rotated in the opposite direction to bring the backup and idler grooving rolls into engagement with the pipe. The workpiece, backup roll and idler grooving roll are then relatively rotated, and the feed screw is manually rotated in the direction to displace the idler grooving roll toward the backup roll to progressively form the peripheral groove in the pipe. When the desired groove depth is reached, relative rotation is stopped and the feed screw is manually rotated in the opposite direction until there is sufficient clearance between the two rolls to accommodate removal of the grooved pipe from between the rolls.

In addition to the time required to manually rotate the feed screw for displacing the grooving rolls away from one another upon completion of a roll grooving operation, it has been impossible heretofore to quickly release the grooving rolls so as to preclude damage to the latter and/or damage to the pipe, or the imposition of undesirable forces on the rolls and other component parts of the roll grooving apparatus upon the occurrence of a problem during the roll grooving operation. For example, it is necessary for the pipe and grooving roll axes to be properly aligned during a roll grooving operation so that the track of the groove is transverse to the pipe axis. Misalignment at the beginning of the operation can cause the track of the groove to be spiral relative to the pipe axis causing the pipe and/or grooving rolls to "walk" in the direction to axially separate the rolls and pipe. If the idler grooving roll is not displaced from the pipe immediately, the pipe can be damaged to the extent that the grooving operation can not be completed so as to provide an acceptable end product. Moreover, axial separation of the pipe and roll grooving apparatus can subject the operator to injury and/or the pipe or grooving apparatus to damage. If the roll grooving apparatus is motor driven, the undesirable tracking can not be quickly stopped in that displacement of the idler grooving roll from engagement with the pipe requires manual rotation of the threaded feed screw. Even if the roll grooving apparatus is manually driven about the periphery of the pipe, improper tracking requires manual displacement of the idler roll through rotation of the feed screw in order to reset the grooving apparatus relative to the pipe.

The tracking problem referred to above is attendant to the operation of any roll grooving apparatus including those in which the grooving roll supports are relatively displaced other than by a feed screw and, for example, hydraulically as shown in U.S. Pat. No. 3,995,466 to Kunsmann, and manually through a pivotal lever arm as disclosed in U.S. Pat. No. 5,079,940 to Pulver et al. Numerous efforts have been made heretofore to provide roll grooving apparatus with a self tracking feature, and these efforts have included supporting the pipe to be roll grooved at an incline to the axes of the grooving rolls as disclosed in the aforementioned patent to Kunsmann, and by inclining the axis of the idler grooving roll relative to the axis of the backup roll as disclosed in U.S. Pat. No. 4,041,747 to Elkin. Other efforts have included contouring the outer surface of the backup roll in the form of a frustum of a cone as disclosed in U.S. Pat. No. 5,279,143 to Dole, and by providing an auxiliary roller engaging the outer surface of a pipe being grooved and having its axis slanted relative to that of the pipe as disclosed in U.S. Pat. No. 2,975,819 to Costanzo et al. While all of the foregoing arrangements promote self tracking, they add undesirably to the expense of the roll grooving apparatus by requiring additional and/or specially designed component parts for the apparatus, thus adding to the cost of maintaining the apparatus as well as the cost of manufacturing the same.

SUMMARY OF THE INVENTION

In accordance with the present invention, roll grooving apparatus is provided with features which minimize or overcome the foregoing and other problems encountered in connection with the structure and operation of roll grooving apparatus heretofore available. In accordance with one aspect of the invention, roll grooving apparatus of the character wherein the grooving roll supports are relatively displaced through the use of a feed screw is provided with a quick release arrangement which enables immediate displacement of the grooving rolls away from one another without having to rotate the feed screw to achieve such displacement. This feature is of particular benefit in conjunction with portable roll grooving apparatus which is adapted to be transported to a site of use and interengaged with the end of an existing pipe or an otherwise rigidly supported pipe and manually driven to move around the perimeter of the pipe to provide a circumferential groove therein. Following the roll grooving operation, the quick release arrangement advantageously enables an operator to remove the apparatus expeditiously from the pipe. This is of particular benefit where the pipe is overhead with respect to the operator or in a restrained area such as in a hole below ground level, or any other environment in which it is difficult for the operator to support the apparatus with one hand while manually rotating the feed screw with the other to achieve release of the apparatus from the pipe. Moreover, in conjunction with roll grooving apparatus which is rigidly supported on a stand or the like and wherein the pipe rotates relative to the apparatus during a roll grooving operation, the quick release feature further advantageously enables an operator to immediately release the rolls upon the occurrence of a problem such as improper tracking.

In accordance with another aspect of the invention, roll grooving apparatus is provided with an improved self tracking feature for urging the grooving rolls and a pipe therebetween axially inwardly of one another during a roll grooving operation. More particularly, the backup roll in accordance with this aspect of the invention is provided with teeth which engage a pipe during a roll grooving operation and urge or bias the back up roll and pipe axially inwardly relative to one another during relative rotation therebetween. Preferably, the teeth have a thrust angle relative to the axis of the backup roll and a radial depth which enables achieving the desired tracking function without undesirably marking the surface of the tube engaged by the backup roll. In this respect, a variety of thrust angles and tooth depths will provide the desired tracking function with respect to pipes of different materials such as copper and steel, but certain combinations of thrust angle and tooth depth are preferred with respect to such different materials in order to assure that any marking of the pipe is acceptable. While it is preferred for purposes of economy to provide the teeth on the backup roll through the use of a knurling tool, the teeth can be otherwise provided, such as by machining. In any event, the circumferentially adjacent teeth engage and urge or bias the pipe and backup roll axially inwardly of one another to maintain a desired axial position therebetween and relative to the idler grooving roll which is cooperable with the backup roll to provide a circumferential groove in the pipe in response to relative rotation between the pipe and the grooving rolls. While the backup roll is generally driven and the cooperating grooving roll is generally an idler roll, it will be appreciated that both rolls can be idler rolls and that the pipe interposed therebetween can be driven to impart relative rotation to the grooving rolls as the latter are relatively advanced radially toward one another during the roll grooving operation.

It is accordingly an outstanding object of the present invention to provide roll grooving apparatus of the character including a feed screw for relatively displacing the grooving rolls with a quick release arrangement enabling immediate separation of the grooving rolls independent of the position therebetween resulting from operation of the feed screw.

Another object is the provision of roll grooving apparatus of the foregoing character with a quick release mechanism which enables an operator to achieve separation of the apparatus and a pipe which has been grooved more readily and with improved control relative to such apparatus heretofore available.

Yet another object is the provision of roll grooving apparatus of the foregoing character with a quick release mechanism which enables separation of the grooving rolls from one another and separation of the apparatus and a pipe which has been grooved more quickly than heretofore possible.

Still a further object is the provision of roll grooving apparatus of the foregoing character with a quick release mechanism which facilitates use of the roll grooving apparatus with a fixed pipe in a location to which access for engaging and disengaging the grooving apparatus from the pipe is inconvenient for an operator of the apparatus.

Still another outstanding object of the invention is the provision of roll grooving apparatus with an improved self-tracking arrangement.

Yet another object is the provision of a backup roll for roll grooving apparatus with an improved self-tracking capability.

Still a further object is the provision of roll grooving apparatus with a backup roll having teeth thereon which engage with a pipe being grooved to urge or bias the pipe and backup roll axially inwardly of one another in response to relative rotation therebetween during a roll grooving operation.

Still another object is the provision of a backup roll of the foregoing character in which the teeth are disposed at a thrust angle relative to the axis of the roll and have a radial depth which, for a given pipe material, achieve the desired self-tracking function without undesirably marking the surface of the pipe engaging therewith.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
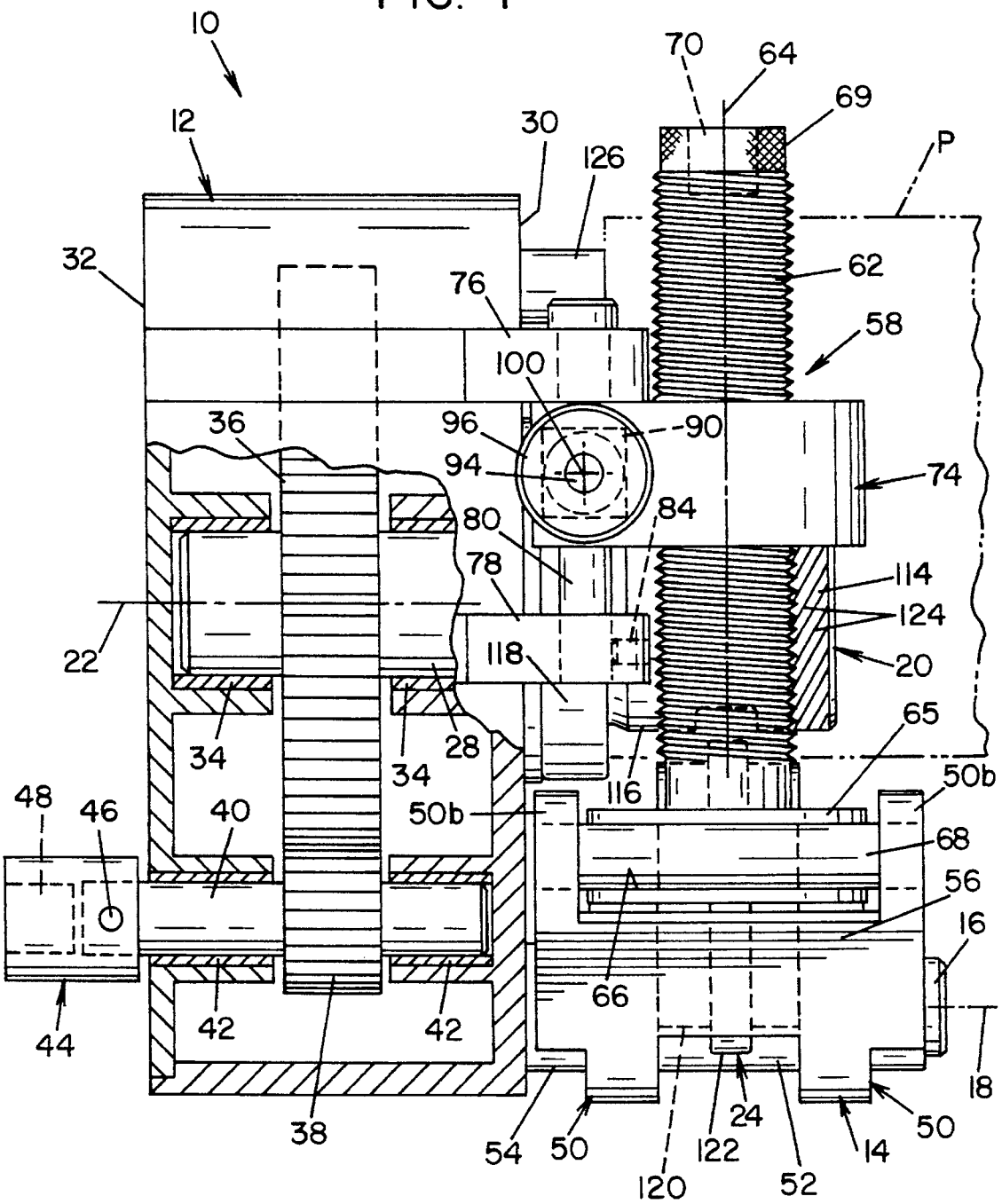
FIG. 1 is a side elevation view partially in section, of roll grooving apparatus according to the present invention.

Referring now in greater detail to the drawings wherein the showings are for the purpose of illustrating preferred embodiments of the invention and not for limiting the same, roll grooving apparatus 10 according to the present invention comprises a first support in the form of a housing 12 and a second support in the form of an arm 14 mounted on housing 12 by means of a pivot pin 16 for pivotal displacement in opposite directions about a pivot axis 18. Housing 12 supports a backup roll 20 for rotation about a backup roll axis 22 parallel to pivot axis 18, and arm 14 supports an idler roll 24 for rotation about an idler roll axis 26 which is parallel to axes 18 and 22. Rolls 20 and 24 are adapted to receive the wall of a thin walled pipe P therebetween and, as described more fully hereinafter, respectively provide female and male grooving rolls cooperable to roll a peripheral groove in pipe P in response to relative rotation between the rolls and pipe and radial displacement of the male idler role toward the female backup roll during such relative rotation.

In the embodiment illustrated, backup roll 20 is adapted to be driven about axis 22 and, for this purpose, is mounted on the axially outer end of a drive shaft 28 which extends through housing 12 and is rotatably supported adjacent front and rear housing walls 30 and 32, respectively, by suitable bearings 34. Drive shaft 28 includes a drive gear 36 which is integral with or suitably secured to the drive shaft against rotation relative thereto, and gear 36 and thus drive shaft 28 is adapted to be rotated by a pinon gear 38 which is integral with or mounted on a pinon shaft 40 against rotation relative thereto. Shaft 40 has axially opposite ends adjacent housing walls 30 and 32 and supported for rotation relative to the housing by suitable bearings 42, and the end of shaft 40 adjacent rear housing wall 32 extends therethrough and is provided with a drive adapter 44 which is secured thereto by a pin 46. Adapter 44 is provided with a non-circular opening 48 extending axially thereunto, and opening 48 is adapted to receive the non-circular output stub shaft of a suitable drive tool such as a ratchet wrench. Thus, it will be appreciated that manual rotation of such a drive tool rotates shaft 40 and thus pinion 38 which in turn rotates gear 36, drive shaft 28 and back up roll 20. As will be described in greater detail hereinafter, rotation of drive roll 20 with pipe P interposed between the latter and idler roll 24 during a roll grooving operation causes roll grooving apparatus 10 to travel about the periphery of pipe P as the groove is rolled therein.

Arm 14 is comprised of axially spaced apart parallel arm members 50 having first ends 50*a* welded or otherwise suitably secured to a sleeve 52 through which pivot pin 16 extends for threaded engagement of inner end 16*a* thereof with a threaded boss 54 provided therefor in housing 12. Arm members 50 extend laterally across housing 12 and have second ends 50*b* axially interconnected by a support plate 56 suitably secured thereto such as by welding. As will be appreciated from FIGS. 2 and 3, pivot axis 18 provided by pin 16 is laterally offset from one side of backup roll axis 22 and the opposite end of the arm as defined by ends 50*b* of the arm members is laterally offset from the opposite side of axis 22. As described in detail hereinafter, the latter end of the arm is interconnected with a feed screw mechanism 58 by which arm 14 is pivoted in opposite directions about axis 18 so as to displace idler roll 24 radially toward and away from backup roll 20. As will be appreciated from FIGS. 2 and 4, idler roll 24 is mounted between arm members 50 for rotation about a shaft pin 60 which provides idler roll axis 26.

Figure 2:
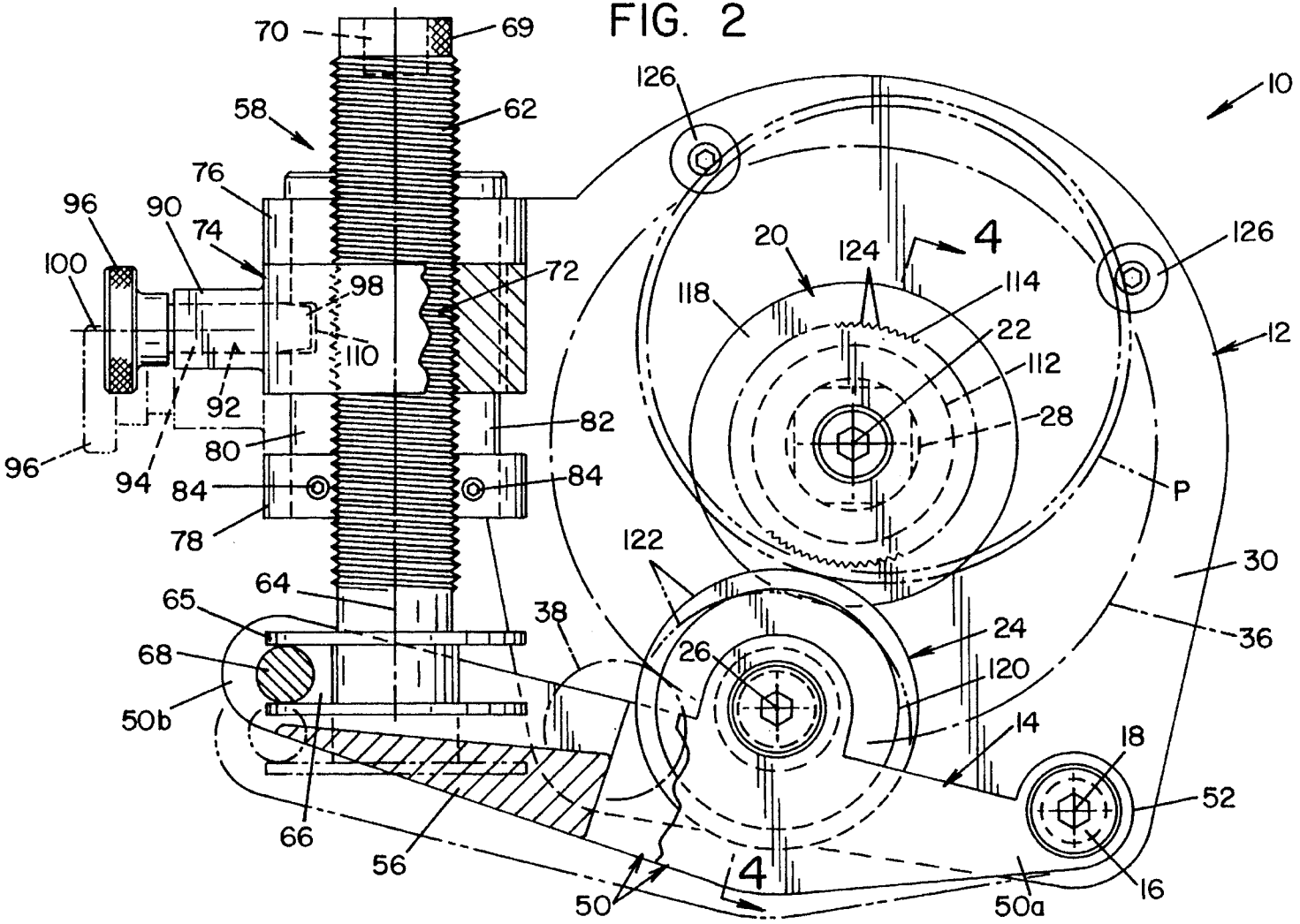
FIG. 2 is a front elevation view of the apparatus partially in section, looking in the direction from right to left in FIG. 1.
Figure 3:
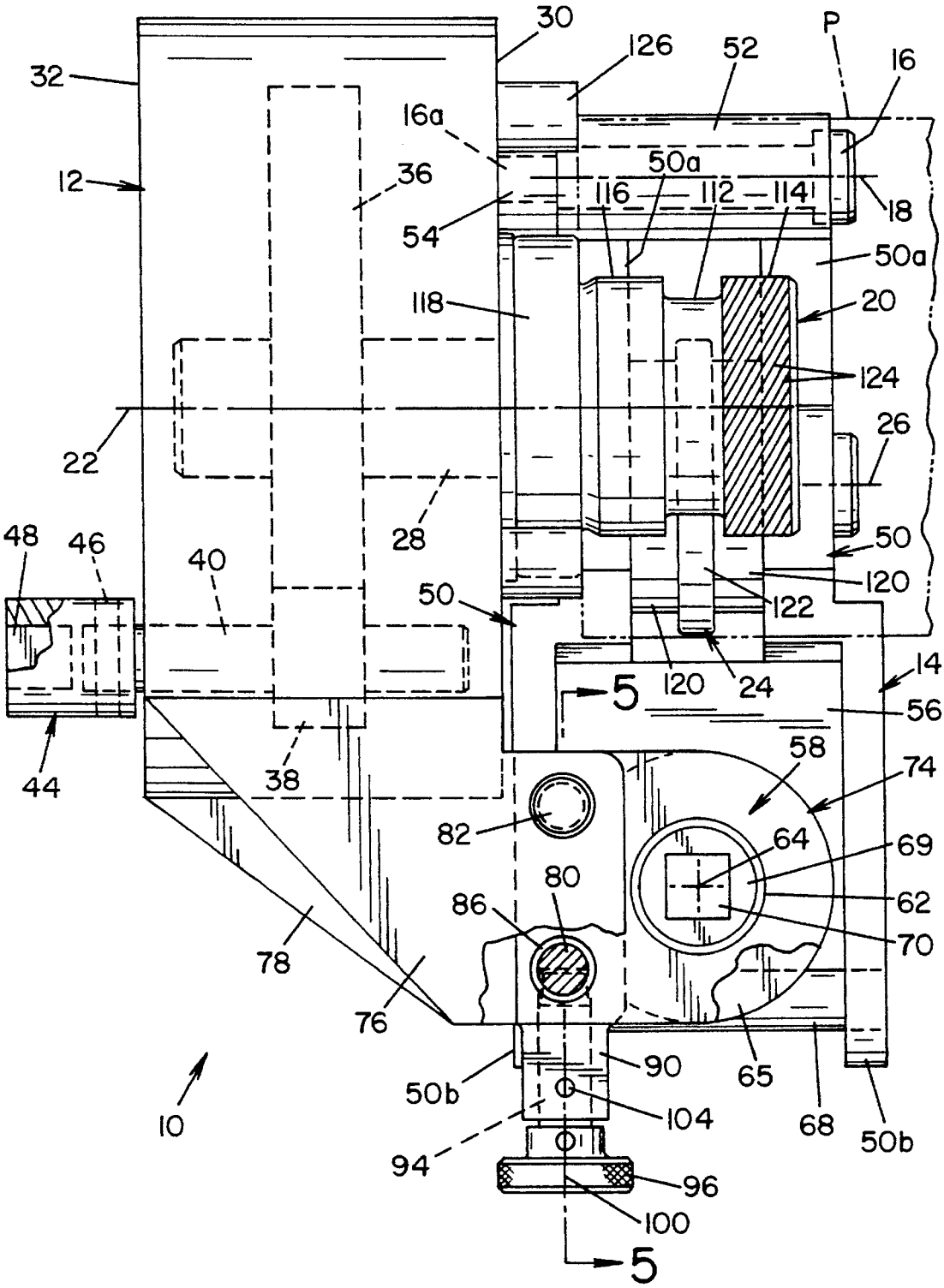
FIG. 3 is a plan view of the apparatus shown in FIG. 1.

As best seen in FIGS. 1–3, feed screw mechanism 58 includes a threaded feed screw member 62 which, in the orientation shown in FIGS. 1 and 2, extends generally vertically and has an axis of rotation 64 laterally spaced from and transverse to grooving roll axes 22 and 26. Feed screw 62 has a lower end provided with a radially recessed collar 65 which is rotatable therewith and which provides a radially inwardly extending annular recess 66 which receives a cross pin 68 extending between and secured to ends 50*b* of arm members 50. The upper end of feed screw 62 is provided with an operating knob 69 by which the feed screw can be rotated by hand, and a non-circular recess 70 extends axially into the upper end of the feed screw for receiving a correspondingly non-circular contoured stub shaft of a suitable tool such as a ratchet wrench by which the feed screw can be rotated. The feed screw is threadedly interengaged intermediate the upper and lower ends thereof with a threaded opening 72 provided therefor in a slide member 74 which, as will become apparent hereinafter, is releasably supported on housing 12 for displacement between latched and released positions relative thereto to provide for quickly releasing idler roll 24 for displacement away from backup roll 20 following a pipe grooving operation.

Figure 5:
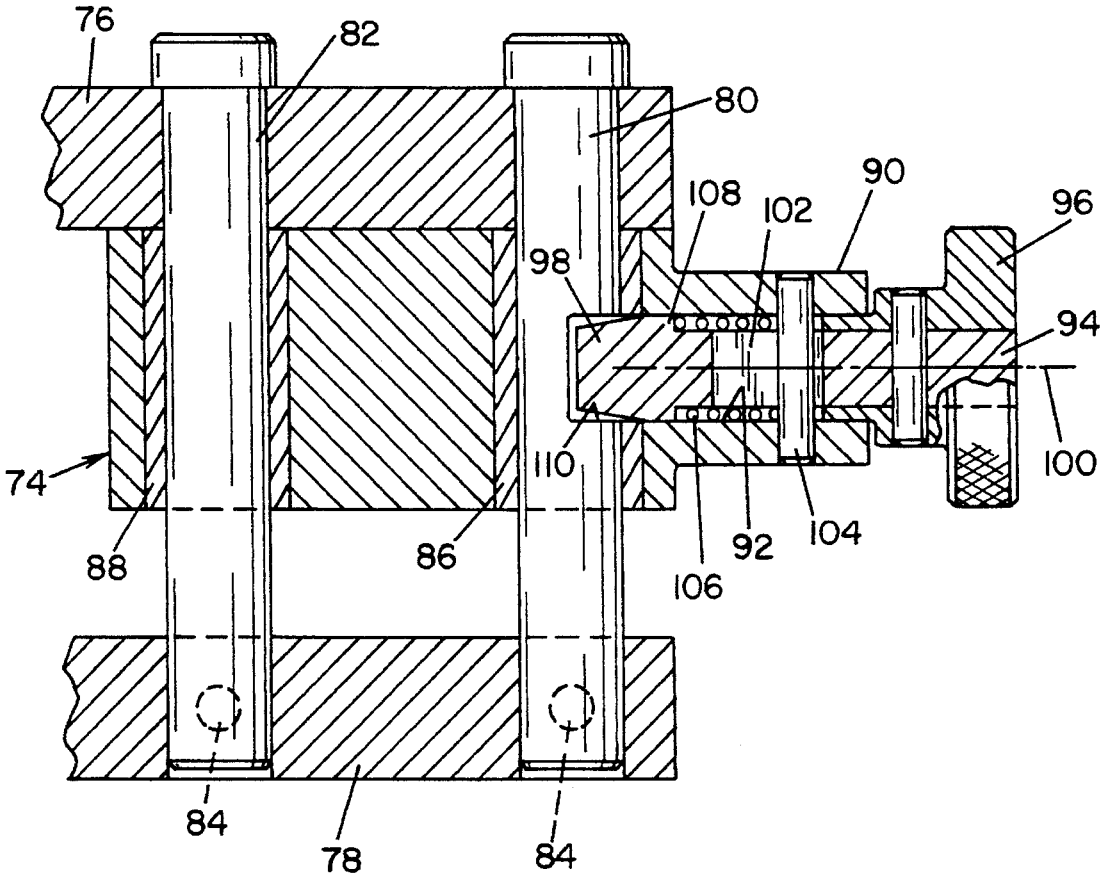
FIG. 5 is a sectional elevation view of the quick release mechanism taken along line 5—5 in FIG. 3.

Housing 12 is provided with a pair of vertically spaced apart laterally outwardly extending upper and lower support plates 76 and 78, respectively. Plates 76 and 78 have axially outer ends extending forwardly of front wall 30 of housing 12 and which are provided with openings, not designated numerically, for supporting a pair of laterally spaced apart vertically extending slide member guide rods 80 and 82 which are secured against displacement from support plates 76 and 78 by set screws 84 engaging the lower ends thereof in support plate 78. As best seen in FIG. 5, guide rods 80 and 82 extend through guide rod openings in slide member 74 and which openings are preferably defined by sleeve bearings 86 and 88. Slide block 74 includes a laterally outwardly extending latch pin boss 90 having a bore 92 reciprocally supporting a latch pin 94 having an operating knob 96 mounted on the outer end thereof and a tapered nose 98 at the inner end thereof. Pin 94 is reciprocable along an axis 100 transverse to guide rod 80 and is provided with an axially extending slot 102 receiving a cross pin 104 by which outward displacement of the latch pin is limited. A biasing spring 106 is interposed between pin 104 and a shoulder 108 on pin 94 to bias the pin inwardly toward guide rod 80. The laterally outer side of guide rod 80 is provided with a laterally inwardly extending bore or recess 110 providing a keeper which receives nose 98 of latch pin 94 when the latter is in its innermost position as shown in FIG. 5. As will be appreciated from the latter figure, axial displacement of latch pin 94 outwardly to the right disengages nose 98 from keeper recess 110, whereby slide member 74 is free to drop along guide rods 80 and 82 into abutting engagement with the upper side of support plate 78. When the component parts are in the positions thereof shown in FIGS. 1, 2 and 5, slide member 74 is in the latched position thereof. As shown by the broken line positions in FIG. 2, when the slide member is in abutting engagement with the upper side of support plate 78 following outward displacement of latch pin 94 as described above, the slide member is in its released position. As will be appreciated in particular from FIG. 2 in light of the foregoing description, displacement of slide member 74 from the latched to the released position thereof displaces feed screw 62 downwardly with the slide block, whereby collar 65 displaces arm 14 counterclockwise about pivot axis 18 to move idler roll 24 away from backup roll 20. It will be further appreciated that such displacement of slide block 74 and feed screw 62 is promoted by the weight of the latter components and arm 14 and, therefore, is quite rapid.

Figure 4:
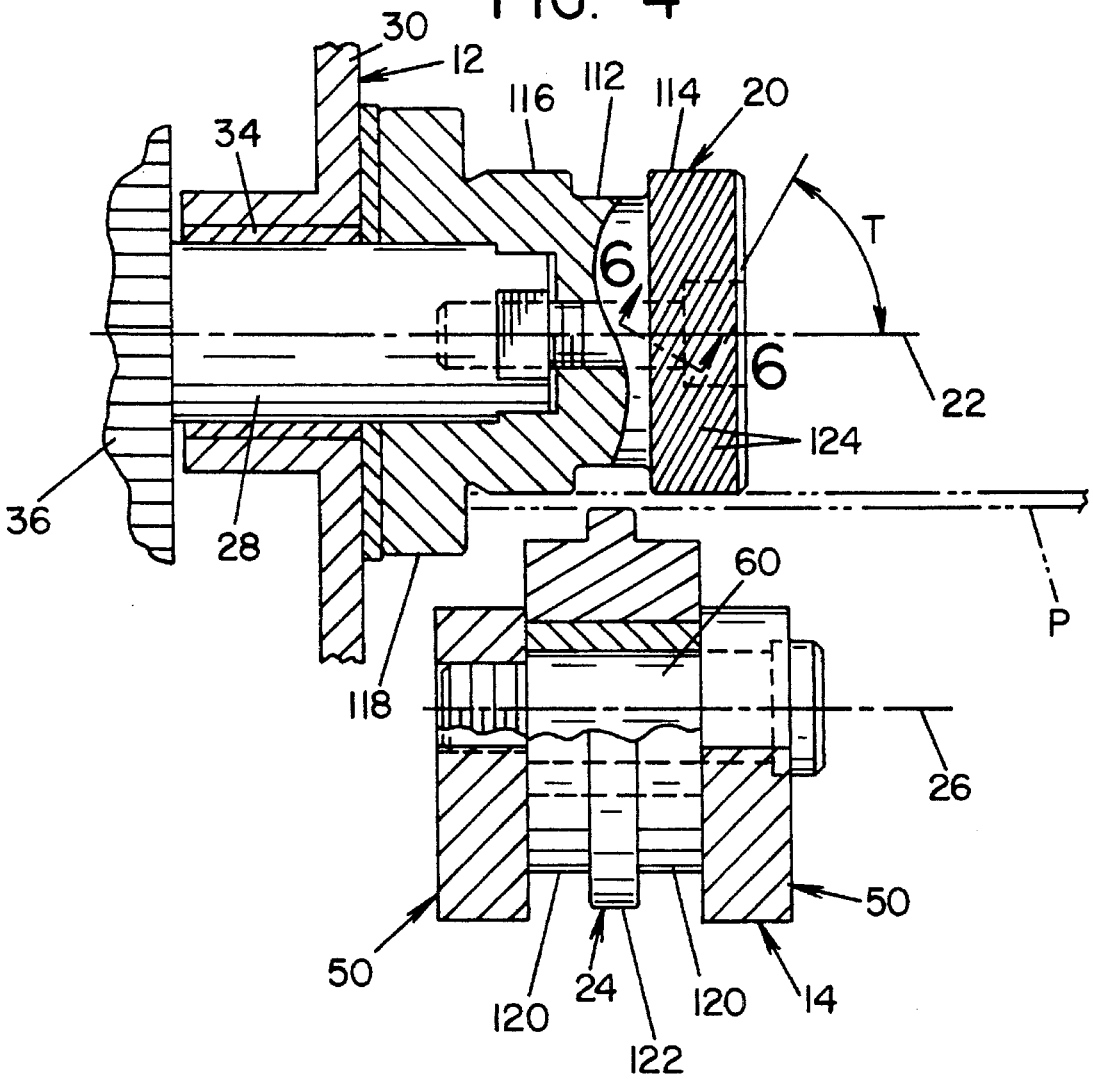
FIG. 4 is a sectional elevation view of the grooving rolls taken along line 4—4 in FIG. 2.
Figure 6:
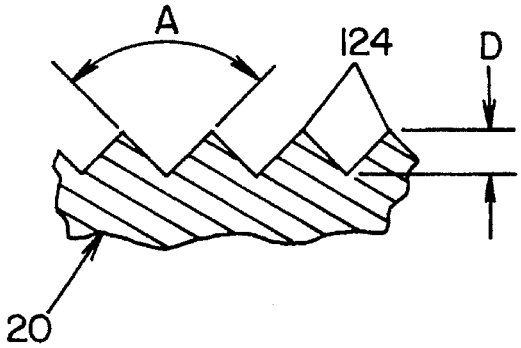
FIG. 6 is a detail view in section of the drive wheel teeth taken along line 6—6 in FIG. 4.

As best seen in FIGS. 2 and 4, backup roll 20 has axially outer and inner ends, not designated numerically, and a circular outer surface which includes a first portion providing a peripheral recess 112 and a second portion defined by surfaces 114 and 116 which are axially outwardly and axially inwardly adjacent recess 112, respectively. Preferably, the backup roll includes a circular flange 118 extending radially outwardly of surfaces 114 and 116 to provide an abutment for positioning a pipe P to be grooved relative to the grooving roles during a roll grooving operation. However, it will be appreciated that such positioning can be achieved by a component mounted on housing 12 as opposed to a component integral with the backup roll. As will be further appreciated from FIGS. 2 and 4, idler roll 24 is of a mating contour and, accordingly, includes circular outer surface portions 120 overlying surface portions 114 and 116 of the backup roll, and a radially outwardly extending circular projection 122 between surfaces 120 and overlying recess 112 in the backup roll. In accordance with another aspect of the present invention, at least axially outer surface 114 of backup roll 20 is provided with teeth 124 extending circumferentially about the backup roll at a thrust angle T with respect to backup roll axis 22. As shown in FIG. 6, adjacent teeth 124 have an included angle A therebetween, and the teeth have a depth D radially of the backup roll. While it is most economical to produce teeth 124 by the use of a knurling tool, the teeth can be otherwise provided, such as by machining. Included angle A is preferably 90°, and the thrust angle T and tooth depth D can vary depending, for example, on the material of the pipe to be grooved, the wall thickness thereof, the weight of the grooving apparatus when the latter is of the type which tracks about a fixed pipe during the roll grooving operation, and the forces imposed on the grooving rolls when the grooving apparatus is fixed and the pipe rotates relative thereto. In connection with thin walled steel and copper pipe, thrust angles of 15°, 30° and 60°, with a tooth depth of 0.062 in. were found to be operable to provide the desired self-tracking. With respect to these variables, the 60° thrust angle provided the best result with respect to urging the pipe and grooving rolls axially inwardly of one another, but the 0.062 in. tooth depth left undesirably aggressive markings on the inner surface of the pipe. In connection with steel pipe, the best results were found to be achieved with a 60° thrust angle and a tooth depth of 0.032 in., and with copper pipe the best results were found to be achieved with a 60° thrust angle and a tooth depth of 0.015 in. In connection with these preferred dimensions, the major effect of tooth depth is in the marking of the inner surface of the tube. In this respect, for example, the foregoing thrust angle and tooth depth dimensions for steel pipe will provide the desired tracking with copper pipe but will leave more aggressive markings on the pipe than will the preferred tooth depth of 0.015 in. for copper pipe. Moreover, while a thrust angle greater than 60° can be used, the bias thereof may urge the end of the pipe against flange 118 with sufficient force to deform the end such as by flaring. It will be appreciated that the direction of thrust angle T relative to backup roll axis 22 is such that rotation of backup roll 20 during a grooving operation with teeth 124 engaging the inner surface of pipe P urges or biases backup roll 20 to the right in FIG. 4 or axially inwardly of pipe P.

It is believed that the operation of the roll grooving apparatus disclosed herein will be apparent from the foregoing description. Briefly in this respect, feed screw 62 is adjusted relative to slide member 74 such that backup roll 20 and grooving roll 24 are radially positioned relative to one another as shown in FIG. 4 when slide member 74 is in its latched position. The apparatus is then mounted on the end of a pipe P to be grooved and the feed screw is further adjusted to assure frictional engagement between the pipe and the grooving rolls. Backup roll 20 is then rotated through the use of a ratchet wrench or the like as described above and such rotation moves the roll grooving apparatus circumferentially about pipe P. During such movement, feed screw 62 is progressively adjusted to displace grooving roll 24 radially toward backup roll 20 whereby projection 122 and recess 112 cooperably interengage with pipe P therebetween to progressively roll a groove in the pipe. During such driving movement of backup roll 20, teeth 124 urge the roll grooving apparatus axially inwardly of pipe P thus to maintain the desired tracking as the groove is formed. Since the roll grooving apparatus in this embodiment moves about fixed pipe P, it is preferred to provide front wall 30 of housing 12 with one or more abutments 126 to stabilize the roll grooving apparatus against tilting relative to drive roll axis 22. When the roll grooving operation is completed, knob 96 is pulled outwardly relative to slide member 74 to release latch pin 94 from guide rod 80 whereupon slide member 74 moves downwardly to its released position which in turn displaces arm member 50 counterclockwise in FIG. 2 about pivot axis 18 to radially separate grooving roll 24 from backup roll 20 whereupon the roll grooving apparatus can be quickly displaced from the end of pipe P.

While considerable emphasis has been placed herein on the structures and structural interrelationships between the component parts of preferred roll grooving apparatus, it will be appreciated that many embodiments can be made and that many changes can be made in the disclosed embodiments without departing from the principals of the invention. In this respect, for example, it will be appreciated that the slide block and release mechanism can be structurally associated with arm 14 rather than housing 12, and that the guide pins for the slide member can be attached thereto for movement therewith relative to openings in the support plates 76 and 78 as opposed to having the rods fixed to the support plates as in the preferred embodiment. In connection with the latter modification, the latch pin would be mounted on the support member for the slide rather than the slide. With regard to the self-tracking backup roll, it will be appreciated that the teeth could be provided on axially opposite sides of the roll grooving recess therein. These and other modifications of the preferred embodiments as well as other embodiments of the invention will be obvious and suggested to those skilled in the art from the description herein, whereby it is to be distinctly understood that the foregoing descriptive matter is to be interpreted merely as illustrative of the present invention and not as a limitation.

We claim:

1. A backup roll for use in the rolling of a groove in a pipe, having an axis and an axially outer end, said backup roll comprising a roll body having an axis of rotation, an axially outer end and a radially outer surface extending circumferentially about said axis of rotation, said outer surface including a first portion providing a rolling groove and a second portion for rotatably engaging a pipe during rolling of a groove therein, and said second portion including tooth means for biasing said pipe and said backup roll axially inwardly relative to one another during said rolling of a groove in said pipe.

2. A backup roll according to claim 1, wherein said tooth means includes a plurality of teeth on said second portion of said outer surface at an angle to said axis of rotation.

3. A backup roll according to claim 2, wherein said angle is from about 15° to 60°.

4. A backup roll according to claim 2, wherein said angle is 60°.

5. A backup roll according to claim 2, wherein said teeth have a radial depth of from about 0.015 inch to about 0.062 inch.

6. A backup roll according to claim 5, wherein said angle is from about 15° to 60°.

7. A backup roll according to claim 6, wherein said radial depth is about 0.032 inch and said angle is about 60°.

8. A backup roll according to claim 6, wherein said radial depth is about 0.015 inch and said angle is about 60°.

9. A backup roll according to claim 1, wherein said outer surface has axially outer and inner ends and said rolling groove is between said ends, said tooth means being between said rolling groove and said outer end.

10. A backup roll according to claim 9, wherein said tooth means includes a plurality of teeth at an angle of about 15° to 60° to said axis of rotation, and said teeth having a radial depth of from about 0.015 inch to about 0.062 inch.

11. A backup roll according to claim 10, wherein said radial depth is about 0.032 inch and said angle is about 60°.

12. A backup roll according to claim 10, wherein said radial depth is about 0.015 inch and said angle is about 60°.

13. In roll grooving apparatus for rolling a circumferential groove in a pipe having an axis and an axially outer end, comprising a grooving roll and a backup roll, means supporting said grooving roll and said backup roll for rotation respectively about a first axis and a second axis generally parallel to said first axis, and means for relatively displacing said grooving and backup rolls radially toward and away from one another, said grooving roll having an axially outer end and a circumferentially extending rolling projection and said backup roll having an axially outer end and a radially outer surface including a circumferentially extending rolling groove, the improvement comprising: said outer surface of said backup roll including tooth means axially adjacent said groove for biasing said backup roll and a pipe being grooved axially inwardly relative to one another in response to relative relation between said backup and grooving rolls and said pipe.

14. The improvement according to claim 13, wherein said backup roll has axially outer and inner ends and said groove is between said ends, and said tooth means is between said groove and said axially outer end.

15. The improvement according to claim 13, wherein said tooth means includes a plurality of teeth extending circumferentially about and axially along said backup roll at an angle to said second axis.

16. The improvement according to claim 15, wherein said angle is from about 15° to 60°.

17. The improvement according to claim 16, wherein said angle is 60°.

18. The improvement according to claim 15, wherein said teeth have a radial depth of from about 0.015 inch to about 0.062 inch.

19. The improvement according to claim 18, wherein said angle is from about 15° to 60°.

20. The improvement according to claim 19, wherein said radial depth is about 0.032 inch and said angle is about 60°.

21. The improvement according to claim 20, wherein said backup roll has axially outer and inner ends and said groove is between said ends, and said tooth means is between said groove and said axially outer end.

22. The improvement according to claim 19, wherein said radial depth is about 0.015 inch and said angle is about 60°.

23. The improvement according to claim 22, wherein said backup roll has axially outer and inner ends and said groove is between said ends, and said tooth means is between said groove and said axially outer end.

24. Roll grooving apparatus for rolling a groove in a pipe comprising, a backup roll, first support means supporting said backup roll for rotation about a backup roll axis, an idler roll, second support means supporting said idler roll for rotation about an idler roll axis parallel to said backup roll axis, means including feed screw means interconnecting said first and second support means for displacement relative to one another to displace said backup roll and said idler roll radially toward and away from one another, said feed screw means including a threaded feed screw having a screw axis, a slide member mounted on one of said first and second support means for sliding movement relative thereto in the direction of said screw axis between latched and released positions, means for releasably holding said slide member in said latched position, and means rotatably interconnecting said feed screw with said slide member and the other of said support means for rotation of said feed screw in first and second opposite directions about said screw axis to respectively displace said backup roll and said idler rolls radially toward and away from one another, said slide member in said released position releasing said first and second support means for displacement of said backup roll and idler roll radially away from one another independent of rotation of said feed screw in said second direction.

25. Roll grooving apparatus according to claim 24, wherein said means for releasably holding said slide member includes latch means on one of said slide member and said one support means and keeper means on the other of said slide member and said one support means.

26. Roll grooving apparatus according to claim 25, wherein said latch means includes pin means supported on said one of said slide member and said one support means for displacement relative thereto between engaged and disengaged positions with respect to said keeper means, and spring means biasing said pin means toward said engaged position.

27. Roll grooving apparatus according to claim 24, wherein said slide member and said one support means include slidably interengaging guide rod means and guide rod opening means parallel to said screw axis and supporting said slide member for movement between said latched and released positions, and said means for releasably holding said slide member in said latched position includes latch means on one of said slide member and said one support means and keeper means on said rod means.

28. Roll grooving apparatus according to claim 27, wherein said guide rod means is on said one support means and said opening means is in said slide member.

29. Roll grooving apparatus according to claim 28, wherein said latch means includes pin means on said slide member, and said keeper means includes recess means in said rod means.

30. Roll grooving apparatus according to claim 29, wherein said pin means is supported on said slide member for displacement transverse to said rod means, and spring means biasing said pin means toward said rod means.

31. Roll grooving apparatus according to claim 24, wherein said feed screw has opposite ends and said means rotatably interconnecting said feed screw with said slide member and said other support means includes means rotatably interconnecting one of said opposite ends of said feed screw and said other support means, and a threaded opening through said slide member receiving said feed screw.

32. Roll grooving apparatus according to claim 31, wherein said one support means includes a pair of guide rods spaced apart and parallel to said screw axis and said slide member includes rod openings slidably receiving said rods, whereby said rods support said slide member for sliding movement between said latched and released positions.

33. Roll grooving apparatus according to claim 32, wherein said one support means includes means to limit displacement of said slide member along said rods in the direction toward said released position.

34. Roll grooving apparatus according to claim 32, wherein said means for releasably holding said slide member includes a latch pin supported on said slide member for reciprocation transverse to one of said rods between latched and unlatched positions and a recess in said one rod receiving said latch pin in said latched position thereof.

35. Roll grooving apparatus according to claim 34, and spring means biasing said latch pin towards said latched position.

36. Roll grooving apparatus according to claim 35, wherein said one support means includes means to limit displacement of said slide member along said rods in the direction toward said released position.

37. Roll grooving apparatus for rolling a groove in a pipe comprising, a drive roll, first support means supporting said drive roll for rotation about a drive roll axis, second support means mounted on said first support means for pivoted displacement about a pivot axis parallel to said drive roll axis, an idler roll mounted on said second support means for rotation about an idler roll axis parallel to said drive roll axis, feed screw means between said first and second support means for displacing said second support means and said idler roll thereon about said pivot axis to displace said idler roll radially toward and away from said drive roll, said feed screw means including a feed screw member having a screw axis transverse to the axes of said drive roll and idler roll and a slide member threadedly interengaged with said feed screw member and mounted on one of said first and second support means for sliding movement relative thereto axially with respect to said screw axis and between latched and released positions, said feed screw member having an end rotatably interconnected with the other of said first and second support means, and means releasably holding said slide member in said latched position.

38. Roll grooving apparatus according to claim 37, wherein said means for releasably holding said slide member includes latch means on one of said slide member and said one support means and keeper means on the other of said slide member and said one support means.

39. Roll grooving apparatus according to claim 38, wherein said latch means includes pin means supported on said one of said slide member and said one support means for displacement relative thereto between engaged and disengaged positions with respect to said keeper means, and spring means biasing said pin means toward said engaged position.

40. Roll grooving apparatus according to claim 37, wherein said one support means includes a pair of guide rods spaced apart and parallel to said screw axis and said slide member includes rod openings slidably receiving said rods, whereby said rods support said slide member for sliding movement between said latched and released positions.

41. Roll grooving apparatus according to claim 40, wherein said means for releasably holding said slide member includes a latch pin supported on said slide member for reciprocation transverse to one of said guide rods between latched and unlatched positions and a recess in said one rod receiving said latch pin in said latched position thereof.

42. Roll grooving apparatus according to claim 41, and spring means biasing said latch pin towards said latched position.

43. Roll grooving apparatus according to claim 42, wherein said one support means includes means to limit displacement of said slide member along said rods in the direction toward said released position.

44. Roll grooving apparatus according to claim 36, wherein said pivot axis is laterally offset from one side of said drive roll axis and said second support means has an end spaced from said pivot axis and laterally offset from the other side of said drive roll axis, said slide member being mounted on said first support means, and said end of said feed screw member being rotatably interconnected with said end of said second support means.

45. Roll grooving apparatus according to claim 44, wherein said slide member and said first support means include interengaging latch and keeper means providing said means releasably holding said slide member.

46. Roll grooving apparatus according to claim 44, wherein said first support means and said slide member include slidably interengaging guide means for guiding movement of said slide member between said latched and released position.

47. Roll grooving apparatus according to claim 46, wherein said slide member and said first support means include interengaging latch and keeper means providing said means releasably holding said slide member.

48. Roll grooving apparatus according to claim 46, wherein said guide means includes guide rod means mounted on one of said first support means and said slide member and guide rod opening means in the other of said first support means and said slide member.

49. Roll grooving apparatus according to claim 48, wherein said guide rod means includes a guide rod having a rod axis and said means releasably holding said slide member includes a latch pin having a pin axis transverse to said rod axis and supported on said other of said first support means and said slide member for displacement toward and away from said guide rod between latched and unlatched positions relative thereto, and said guide rod including keeper means engaging with said latch pin in said latched position thereof.

50. Roll grooving apparatus according to claim 46, wherein said guide means includes a pair of guide rods mounted on said first support means and guide rod openings through said slide member receiving said guide rods.

51. Roll grooving apparatus according to claim 50, and stop means on said first support means for limiting displacement of said slide member in the direction between said released and latched positions thereof.

52. Roll grooving apparatus according to claim 50, wherein said means for releasably holding said slide member includes a latch pin supported on said slide member for reciprocation transverse to one of said rods between latched and unlatched positions and a recess in said one rod receiving said latch pin in said latched position thereof.

53. Roll grooving apparatus according to claim 52, and spring means biasing said latch pin towards said latched position.

54. Roll grooving apparatus according to claim 53, and stop means on said first support means for limiting displacement of said slide member in the direction between said released and latched positions thereof.

* * * * *